US010428550B2

(12) United States Patent
Huang

(10) Patent No.: US 10,428,550 B2
(45) Date of Patent: Oct. 1, 2019

(54) TENT CLOTH CONNECTING STRUCTURE FOR A FOLD-UP TENT

(71) Applicant: XIAMEN ROADZUP OUTDOOR PRODUCTS CO., LTD., Xiamen (CN)

(72) Inventor: Changjiu Huang, Xiamen (CN)

(73) Assignee: XIAMEN ROADZUP OUTDOOR PRODUCTS CO., LTD., Xiamen (CN)

( * ) Notice: Subject to any disclaimer, the term of this patent is extended or adjusted under 35 U.S.C. 154(b) by 150 days.

(21) Appl. No.: 15/622,268

(22) Filed: Jun. 14, 2017

(65) Prior Publication Data

US 2017/0362853 A1 Dec. 21, 2017

(30) Foreign Application Priority Data

Jun. 15, 2016 (CN) ..... 2016 1 0422334

(51) Int. Cl.

| | |
|---|---|
| ***E04H 15/64*** | (2006.01) |
| ***E04H 15/60*** | (2006.01) |
| ***E04H 15/42*** | (2006.01) |
| ***E04H 15/32*** | (2006.01) |

(52) U.S. Cl.

CPC ..... *E04H 15/64* (2013.01); *E04H 15/322* (2013.01); *E04H 15/42* (2013.01); *E04H 15/60* (2013.01)

(58) Field of Classification Search

CPC ..... E04H 15/32; E04H 15/322; E04H 15/34; E04H 15/42; E04H 15/54; E04H 15/64

See application file for complete search history.

(56) References Cited

U.S. PATENT DOCUMENTS

| | | | | |
|---|---|---|---|---|
| 5,197,504 A * | 3/1993 | Howe | E04H 15/425 | 135/119 |
| 6,279,208 B1 * | 8/2001 | Gillis | E04H 15/64 | 24/265 H |
| 6,776,179 B1 * | 8/2004 | Chen | E04H 15/42 | 135/135 |
| 2015/0330099 A1 * | 11/2015 | Zhou | E04H 15/48 | 135/143 |
| 2018/0023314 A1 * | 1/2018 | Day | E04H 15/322 | 135/123 |

FOREIGN PATENT DOCUMENTS

| | | | |
|---|---|---|---|
| CA | 2843289 A1 * | 9/2014 | E04H 15/32 |
| DE | 19805183 A1 * | 8/1998 | E04H 15/42 |

* cited by examiner

*Primary Examiner* — David R Dunn
*Assistant Examiner* — Danielle Jackson
(74) *Attorney, Agent, or Firm* — Rabin & Berdo, P.C.

(57) ABSTRACT

A tent cloth connecting structure for a fold-up tent includes a leg pole including first and second poles that slide relative to one another; and a tent cloth having a lower portion disposed with a first connecting unit and a first flexible element, a second connecting unit disposed above the first connecting unit, and a sliding element attached to the tent cloth and slidably connected to the first pole. The sliding element and a lower portion of the first pole are retained by a locking structure. The first pole is disposed with a limit structure limiting passage of the second connecting unit and having a protruding portion. The second connecting unit includes a connecting base slidably connected to the first pole and located below the protruding portion which limits the passage of the connecting base, and a second flexible element that connects the connecting base and the tent cloth.

6 Claims, 9 Drawing Sheets

TENT CLOTH CONNECTING STRUCTURE FOR A FOLD-UP TENT

BACKGROUND OF THE ART

1. Field of the Invention

The present invention relates to a connecting structure of a tent cloth and a leg pole of a fold-up tent.

2. Background of the Related Art

An all-in-one fold-up tent comprises a tent rack and a tent cloth. The tent rack comprises a top base, a plurality of top tent poles and a plurality of leg poles. One end of the top tent pole is rotatably connected to the top base. The top tent poles are arranged with space in the periphery, the other end of each tent pole is rotatably connected to the top end of the leg pole. The fold-up method is that the other end of the top tent poles rotate with respect to the top base from bottom to top to realize folding and from top to bottom to realize unfolding. The tent cloth is hanging to the tent rack, the bottom portion of the tent cloth is connected to the bottom portion of the leg poles, the tent cloth is then tensioned, the hanging method is using a hook connecting to the tent cloth by a flexible belt. The hook is hooked to the rack pole. During the top tent pole rotating from bottom to top to fold, the central and bottom portion of the tent pole turns up, the tent cloth then covers the tent rack but not hanging in the tent rack. The disadvantages are that: 1. if the tent cloth is just coupled to the tent rack, although the tent rack is flat when being unfolded, the tent cloth deforms and lengthens during the unfolding to adjust to the tent rack, the tent cloth is always in deforming and tensioning, making it easy to damage and inconvenient to unfold; 2. if the tent cloth is overlong, although it is convenient to fold and unfold and the tent cloth doesn't deform, the tent cloth is loose and not flat when the tent is set up, making the appearance not attractive and low strength and stability.

SUMMARY OF THE INVENTION

The present invention is provided with a connecting structure of a tent cloth and a leg pole of a fold-up tent, which overcomes the disadvantages of the existing known technology.

The technical proposal of the present invention is that:

A connecting structure of a tent cloth and a leg pole of a fold-up tent, comprising a leg pole and a tent cloth, the leg pole comprises a first pole and a second pole, the second pole and the first pole are arranged up and down and are slidable relatively to change the length of the leg pole; wherein the bottom portion or the lower portion of the cloth is disposed with a first connecting unit to tension the tent cloth, the first connecting unit comprises a sliding element connected to the tent cloth, the sliding element is slidably connected to the first pole, the sliding element and the bottom portion or the lower portion of the first pole is disposed with a lock structure used to position the sliding element to the bottom portion of the lower portion of the first pole.

In another preferred embodiment, the sliding element comprises a sliding base slidably connected to the first pole.

In another preferred embodiment, the sliding element comprises a third pole slidably connected to the first pole, the bottom portion or the lower portion of the tent cloth is connected to the bottom portion or the lower portion of the third pole.

In another preferred embodiment, the first connecting unit further comprises a first flexible element, the first flexible element connects the sliding element and the tent cloth.

In another preferred embodiment, the first pole is disposed with a limit structure, the limit structure limits the sliding element to pass through the limit element and slide up along the first pole.

In another preferred embodiment, the tent cloth further comprises a second connecting unit used to tension the tent cloth, the second connecting unit is disposed above the first connecting unit, the first pole is disposed with a limit structure, the second connecting unit is connected to the first pole, the limit structure at least limits the second connecting unit to pass through the limit structure and slide up along the first pole.

In another preferred embodiment, the second connecting unit comprises a connecting base, a second flexible element connects the connecting base and the tent cloth; the connecting base is fixedly connected to the first pole, the fixing connecting of the connecting base and the first pole forms above mentioned limit structure.

In another preferred embodiment, the limit structure comprises a protruding fixedly connected to the first pole and protruding with respect to the external wall of the first pole; the second connecting unit comprises a connecting base, a second flexible element connects the connecting base and the tent cloth; the connecting base is slidably connected to the first pole and is located below the protruding, the protruding limits the connecting base to pass through the protruding and slide up along the first pole.

In another preferred embodiment, the leg pole changes between a contracting state and a stretch state by the respective slide of the first pole and the second pole, the leg pole transmits the lock structure to drive the lock structure to unlock when the leg pole changes from the stretching state to the contracting state.

In another preferred embodiment, the first pole is a tube, the second pole is slidably inserted to the first pole; the lock structure comprises a through hole passing through the tube of the first pole inside and outside, an elastic lock disposed in the tube of the first pole and a lock hole disposed at the sliding element; one end of the elastic lock is fixedly connected to the inner wall of the tube of the first pole, the other end is disposed with a lock portion, the lock portion is disposed with a column, the column passes through the through hole under the action of the elastic force between the two ends of the elastic lock and is capable of inserting to the lock hole for locking; the leg pole transmits the lock portion of the lock structure to drive the lock portion to move such to unlock when the leg pole changes from the stretching state to the contracting state.

In another preferred embodiment, the top surface of the column is disposed with a second guiding surface, the bottom end portion of the second pole is disposed with a guiding base, the guiding base abuts against the second guiding surface and transmits the second guiding surface, such that the second pole slides downwardly to drive the lock portion to move to make the column contract.

In another preferred embodiment, the bottom end portion of the second pole is fixedly disposed with a guiding base, the bottom surface of the guiding base is concaved with a groove, the groove wall of the groove is disposed with a first guiding surface; the first guiding surface abuts against the lock portion and transmits the lock portion, such that the second pole slides downwardly to drive the lock portion to move to make the column contract.

Compared to the existing known technology, the technical proposal of the present invention has advantages:

1. The first connecting unit comprises a sliding element slidably connected to the first pole, a lock structure is disposed between the sliding element and the bottom portion or the lower portion of the first pole. When the tent is unfolded, the bottom portion or the lower portion of the tent cloth is connected to the bottom portion or the lower portion of the leg pole by locking connecting, making the tent cloth flat. The tent has high strength and high stability. During the folding, the lock structure is unlocked, by the relative sliding between the first pole and the second pole, on one hand, the leg pole is shortened (with respect to the tent cloth), on the other hand, the sliding element slides upwardly to loosen the tent cloth relatively, avoiding it unable or difficult to fold due to the short tent cloth. The tent is convenient to fold and unfold.

2. The leg pole changes between contract state and stretch state by the relative slide of the first pole and the second pole, during the leg pole slides from stretching state to contract state, the lock structure is transmitted to unlock, the lock structure is unlocked by the length change between the second pole and the first pole. This action of changing the length of the second pole and the first pole can achieve unlock, avoiding that the user needs to change the length of leg pole and operate the lock structure, making it convenient and fast.

BRIEF DESCRIPTION OF THE DRAWINGS

The present invention will be further described with the drawings and the embodiments.

DETAILED DESCRIPTION OF THE EMBODIMENTS

Figure 1:
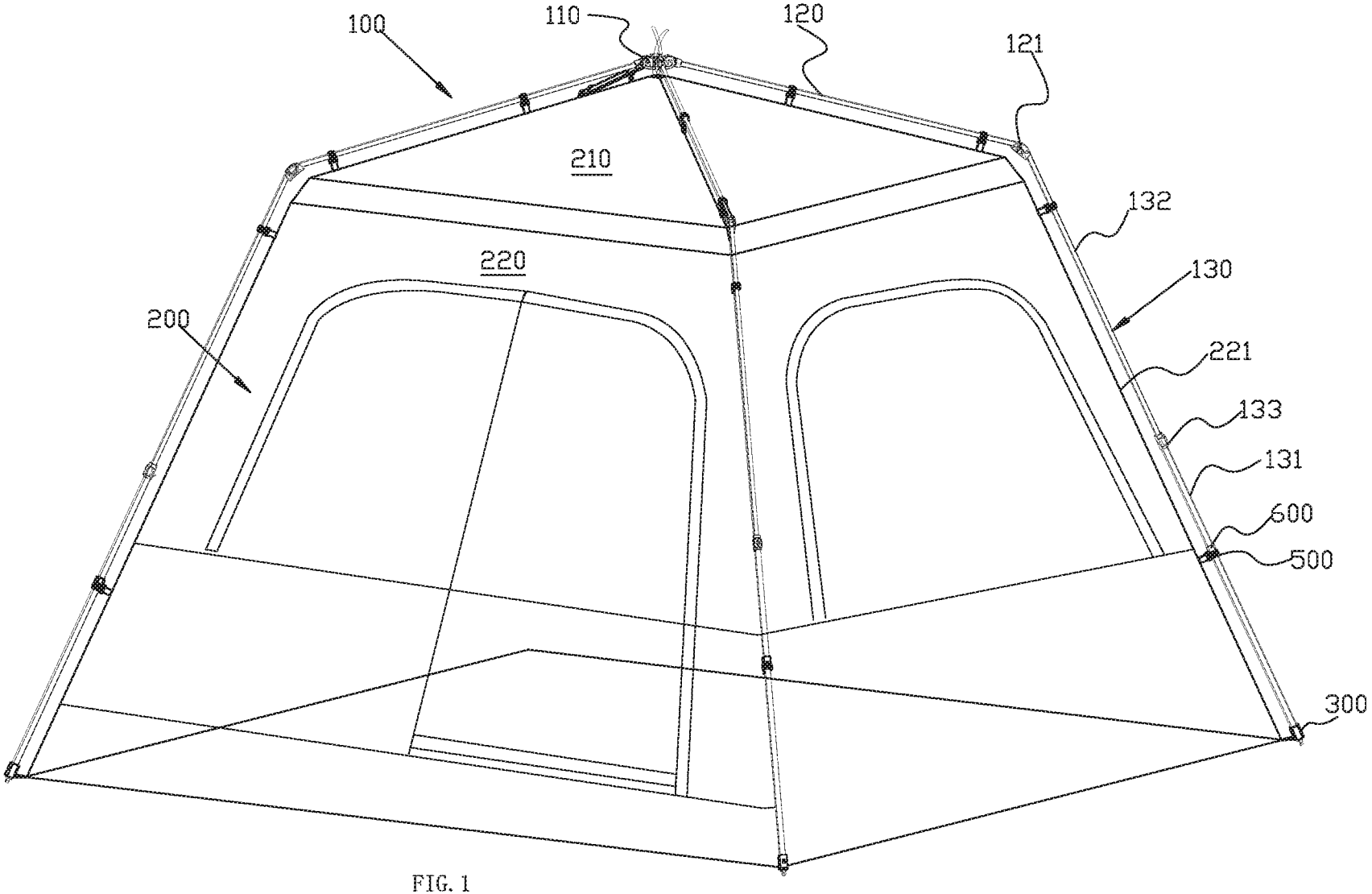
FIG. 1 illustrates a schematic diagram of the tent in unfolding state.

Referring to FIGS. 1-11, a fold-up tent comprises a tent rack 100 and a tent cloth 200. The tent rack 100 comprises a top base 110 and top tent poles 120, one end of the top tent pole 120 is rotatably connected to the top base 110, the top tent poles 120 are arranged with space in the periphery, the other end of each top tent pole 120 is rotatably connected to a leg pole 130. For example, the other end of the top tent pole 120 is rotatably connected to the leg pole 130 by a rotating joint 121. The top tent pole 120 can be a single pole, a flexible pole or a folding pole set. The folding pole set comprises at least two pole elements with the ends rotatably connected (by a rotating joint); the other end of the top tent pole 120 rotates from top to bottom to realize unfolding and from bottom to top to realize folding; preferred, a rotating limit structure is disposed between the top base 110 and the end of the top tent pole 120, the rotating limit structure limits the top tent pole 120 to rotate not exceed a preset angle from top to bottom, when the top tent pole 120 rotates to the preset angle, it is unfolded. The leg pole 130 comprises a first pole 131 and a second pole 132 capable of sliding relatively to change the length of the leg pole 130. The leg pole 130 is a flexible tube comprising a first pole 131 and a second pole slidably inserted to the first pole 131, the flexible tube is disposed with a lock mechanism 133, the lock mechanism 133 can lock the first pole and the second pole to make the leg pole retain a preset length, the lock mechanism can be unlocked, so that the first pole and the second pole slide to adjust the length of the leg pole, the lock mechanism is locked when the length is adjusted. The lock mechanism comprises an elastic lock, a through hole and a lock hole. In this embodiment, the flexible pipe is an inside-outside structure, but not limited to this, other structures like side-by-side structure are available.

The connecting structure of the tent cloth 200 and the leg pole 130 is that: the tent cloth 200 comprises a top tent cloth 210 and periphery tent cloths 220 corresponding to the leg poles 130, the periphery tent cloths 220 are disposed with seal line portions 221 corresponding to the leg poles 130, the bottom portion of the seal line portion 221 is disposed with a first connecting unit 300 to make the tent cloth flat, a lock structure 400 is disposed between the first connecting unit 300 and the bottom portion of the first pole 131 to position the first connecting unit 300 to the bottom portion of the first pole 131; the seal line portion 221 of the tent cloth 200 is further disposed with a second connecting unit 500 to tension the tent cloth 200, the second connecting unit 500 is disposed above the first connecting unit, the first pole 131 is disposed with a limit structure 600. The second connecting unit 500 is connected to the first pole 131 and the limit structure 600 at least limits the second connecting unit 500 to pass through the limit structure 600 and slide upwardly along the first pole 131. In this embodiment, the first connecting unit is disposed at the bottom portion, or at the lower portion as needed.

The first connecting unit 300 comprises a sliding element 310, which is slidably connected to the first pole 131, the sliding element 310 and the edge line 221 of the tent cloth 200 are connected by a first flexible element 320, the first flexible element 320 is a flexible belt or a flexible tape or a flexible piece, the first flexible element 320 is fixedly connected to the tent cloth by sewing, welding or melting, the other end is fixedly connected to the sliding element 310 by sewing, welding or melting, in another case, the other end is reversed and fixed to form a ring body by sewing, welding or melting. The ring body is sleeved on the sliding element 310, such to connect the sliding element and the tent cloth by the flexible element. The lock structure 400 is disposed between the sliding element 310 and the bottom portion of the first pole 131.

The limit structure 600 comprises a protruding portion 610 fixedly protruding from the outer wall of the first pole 131, the protruding portion 610 is fixedly sleeved on the fixing ring of the outer wall of the first pole 131; the second connecting unit 500 comprises a connecting base 510, the connecting base 510 and the edge line portion 221 of the tent cloth 200 are connected by a second flexible element 520; the connecting base 510 is slidably connected to the first pole 131 and is disposed below the protruding portion 610; the protruding portion 610 limits the connecting base 510 to pass through the protruding portion 610 and slide upwardly along the first pole 131, the sliding base 510 is a hook or a sliding base. But not limited to this, as needed, the second connecting unit 500 comprises the connecting base 510, the connecting base 510 is directly fixed to the first pole 131, it can also limit the connecting base 510 to slide up and forms the limit structure 600. Or in another case, the second connecting unit 500 comprises a flexible element, which is directly tied to the bottom portion of the first pole or sleeved on the bottom portion of the first pole, forming the limit structure 600.

Preferred, the leg pole 130 changes between the contracting state and the stretching state by the relative slide of the first pole 131 and the second pole 132. During the leg pole 130 changes from the stretching state to the contacting state, the lock structure 400 is transmitted to unlock. In a detailed structure, the lock structure comprises a through hole 410 passing through the tube of the first pole 131 inside and outside, an elastic lock 420 disposed in the tube of the first pole and a lock hole 430 disposed at the sliding element; one end of the elastic lock 420 is fixedly connected to the inner wall of the tube of the first pole, the other end is disposed with a lock portion 440, the lock portion 440 is disposed with a column 441, the column 441 passes through the through hole under the action of the elastic force between the two ends of the elastic lock 420 and is capable of inserting to the lock hole for locking; pressing the column 441 down can realize unlock.

In this embodiment, the elastic lock 420 is V shaped, the center of one side of the V shape elastic lock 420 is protruded to form a convex portion 421, the lock portion 440 is concaved with a concave portion 442, the convex portion 421 and the concave portion 442 couple to make the lock portion and the elastic lock 420 fixedly connected. The coupling is that the convex portion elastically deforms to lock to the concave portion. The lock portion 440 is disposed with a side surface opposite to the first end of the elastic lock, the column 441 is protruding on the side surface; the lower end of the second pole 132 is fixedly disposed with a guiding base 134, the bottom surface of which is concaved with a groove 135, the groove wall of the groove 135 is disposed with a first guiding surface 136, the first guiding surface 136 is an arc groove or an incline groove; the first guiding surface 136 can abut against the top portion of the lock portion 440 in transmitting way, such that when the second pole 132 slides downwardly, it can drive the lock portion 440 to move to make the column 441 contract; the top surface of the column 441 is a second guiding surface 443, the guiding base 134 can abut against the second guiding base 443 in transmitting way, such that the second pole 132 slides downwardly to drive the lock portion 440 to move to make the column 441 contract. Two guiding surfaces can be alternatively contracted, or both are contracted to ensure to contract to unlock. Preferred, the side surface of the lock portion 440 and the inner wall of the first pole are spaced; the guiding base 134 comprises a fixing portion fixedly inserted to the lower end portion of the second pole and a coupling portion fixedly connected to the fixing portion and extending out of the outer wall of the second pole, the bottom surface of the coupling portion is disposed with above mentioned groove. The coupling portion is disposed with a side portion 137 corresponding to the groove. The side portion can be inserted to the space, making sure that the lock portion can be coupled to the first guiding surface and making sure that the side portion can be coupled to the column; the top portion of the lock portion can be a guiding head, for example a ball head or an incline surface.

As needed, the lower end portion of the lower pole is fixedly disposed with an assembly base 450, which comprises a longitudinal base contacted with the inner wall of the tube of the lower pole and a lateral base fixedly connected below the longitudinal base, one end of the elastic lock abuts against the longitudinal base.

To further describe the principle and advantages of the present invention, the folding and unfolding of the tent of the present invention will be described hereafter.

Figure 2:
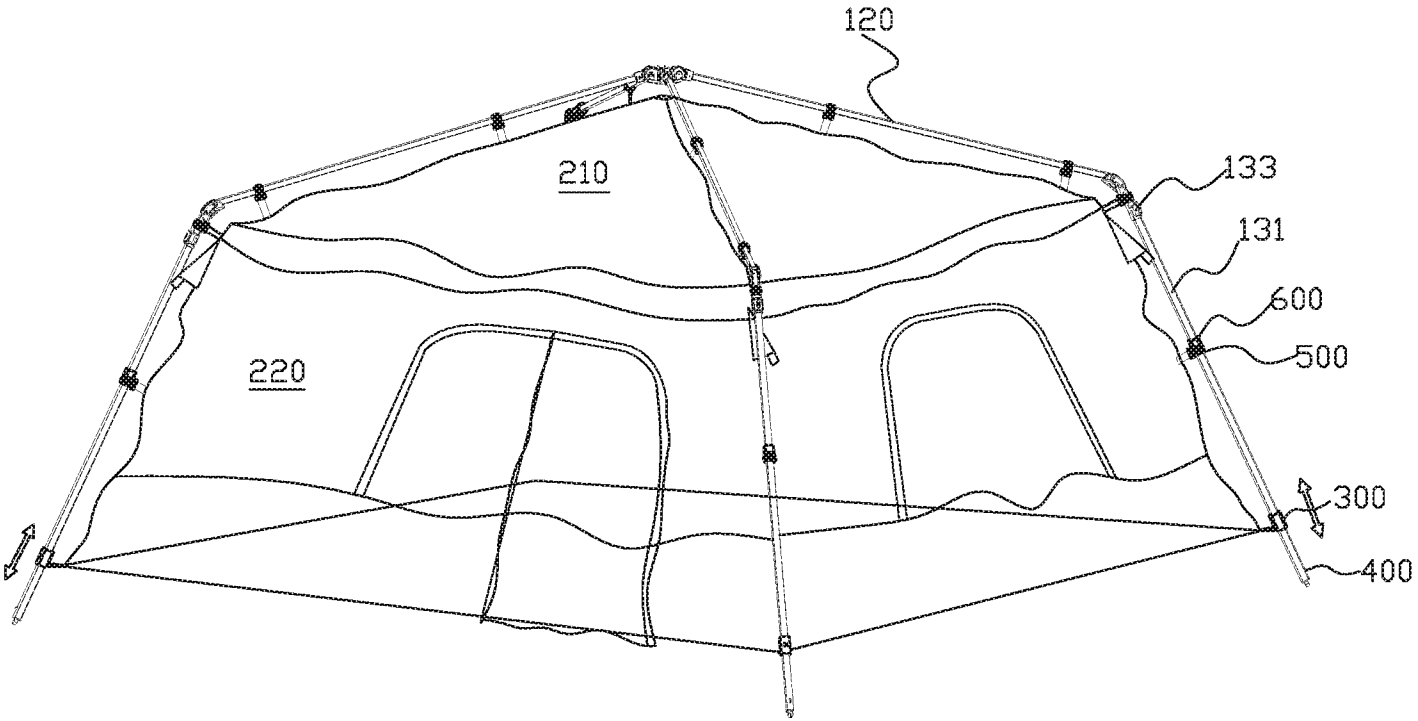
FIG. 2 illustrates a schematic diagram of the tent when the leg pole of the tent contracts.
Figure 3:
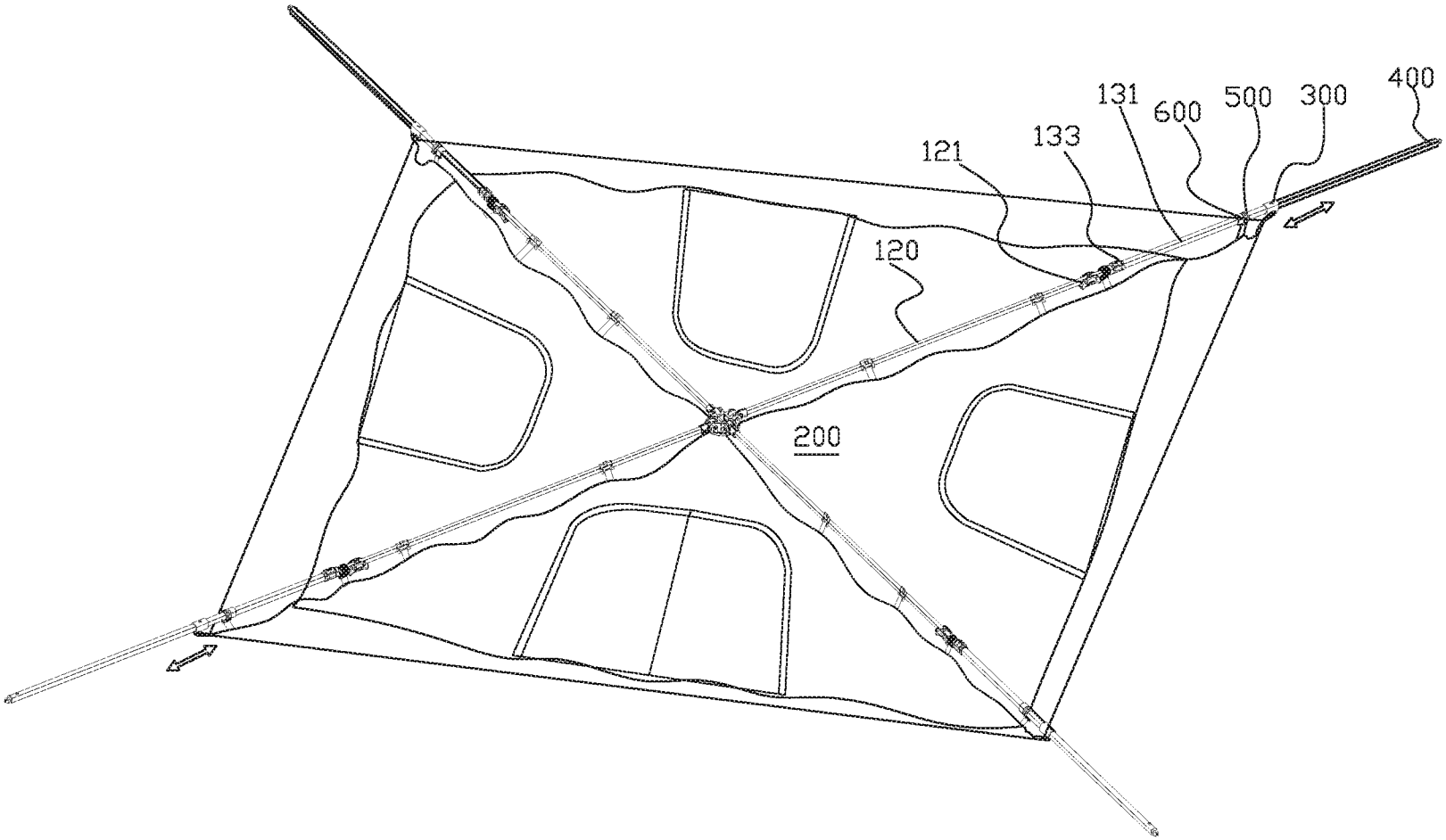
FIG. 3 illustrates a schematic diagram of the tent when the lock structure of the tent is unlocked.
Figure 9:
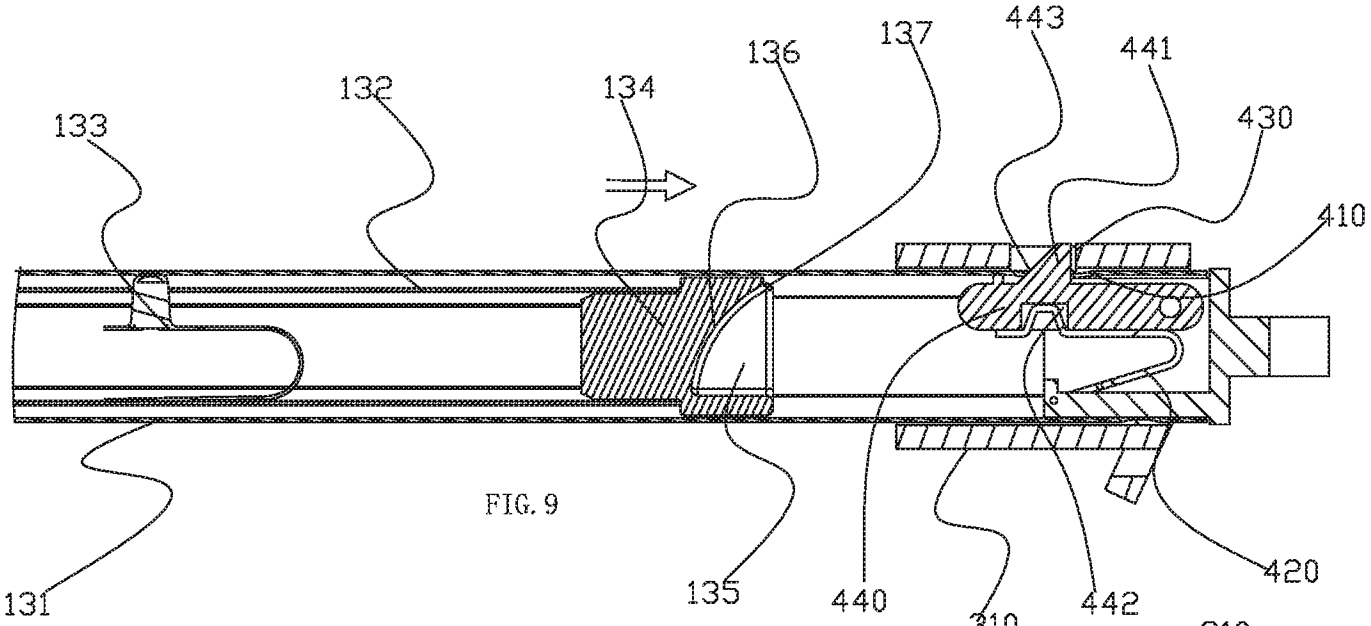
FIG. 9 illustrates a sectional diagram of the connecting structure of the tent cloth and the leg pole mainly with the lock structure when the lock structure is in lock state.
Figure 10:
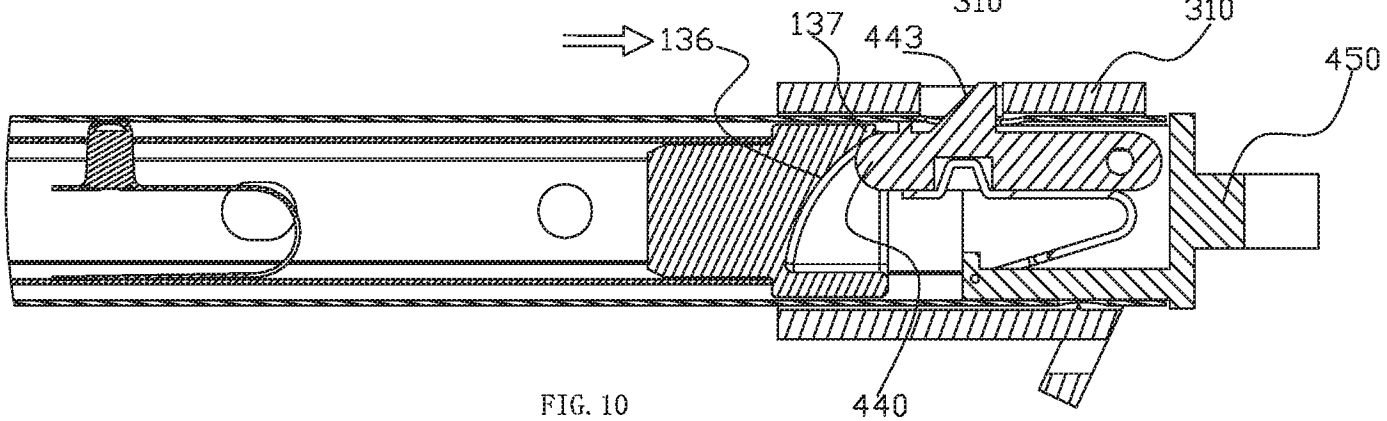
FIG. 10 illustrates a sectional diagram of the connecting structure of the tent cloth and the leg pole, mainly with the lock structure, when the lock structure is in the process from lock state to unlock state.
Figure 11:
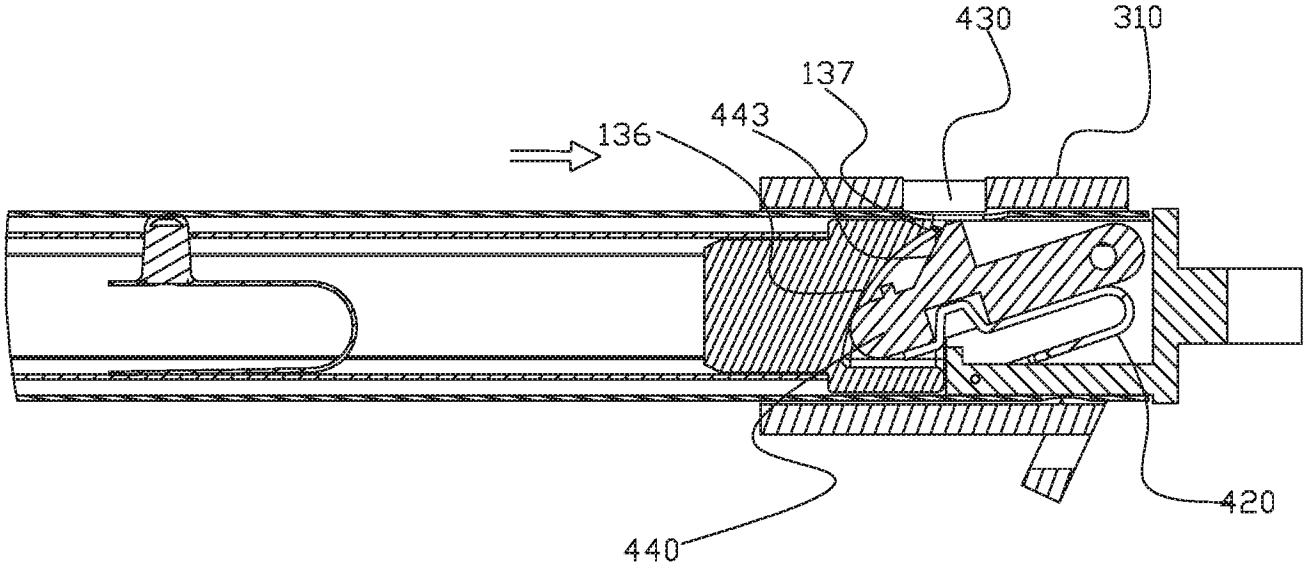
FIG. 11 illustrates a sectional diagram of the connecting structure of the tent cloth and the leg pole, mainly the lock structure, when the lock structure is in unlock state.

Folding process: referring to FIG. 1 and FIG. 2, operating the lock mechanism 133 of the leg pole 130 to unlock the lock mechanism 133, the first pole 131 and the second pole 132 of the leg pole 130 slide relatively to shorten the length; referring to FIGS. 9-11, when the side portion of the coupling portion of the guiding base 134 of the second pole 132 of the leg pole 130 enters to the space, the first guiding surface 136 of the guiding base 134 contacts the top portion of the lock portion 440; under the action of the gravity, the second pole slides downwardly, making the first guiding surface of the guiding base abuts against the lock portion and transmits the lock portion 440 to drive the lock portion 440 to move, the lock portion 440 swings with respect to the shared end of the V shape of the elastic lock 410, making the column 441 contract; the side portion of the coupling portion of the guiding base 134 couples to the second guiding surface of the column, making the column further contract; by the two guiding surfaces, the column is contracted to unlock, the lock structure is unlocked, achieving automatically unlock by gravity; the sliding element 310 of the first connecting unit 300 slides upwardly to the second connecting unit, as figured in FIG. 3, the tent is fully flat to the set up surface, making it convenient to fold; rotating and folding the leg poles, the top tent poles and folding the rack are not limited by the not long enough cloth.

Figure 4:
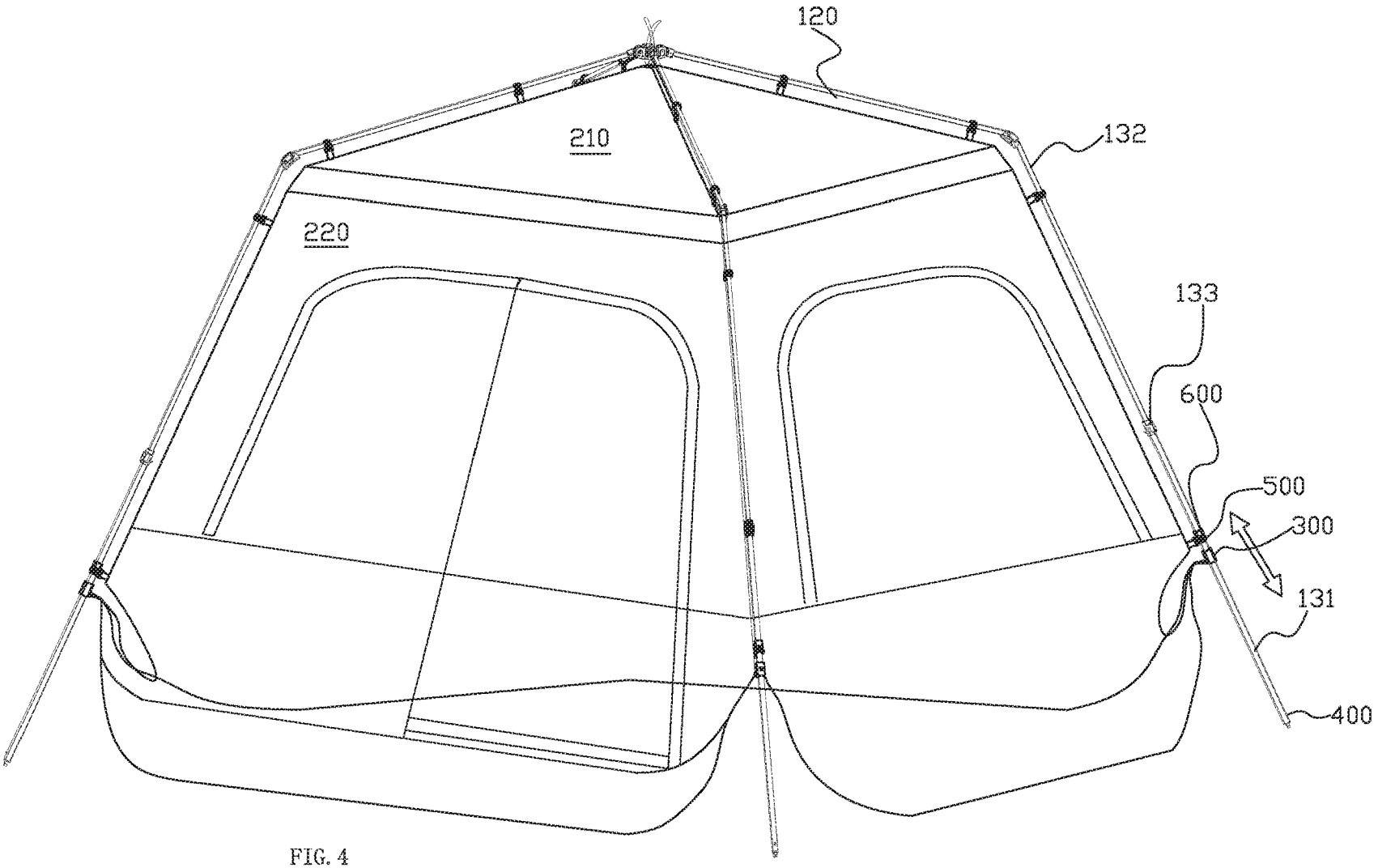
FIG. 4 illustrates a schematic diagram of the tent when the sliding element slides downwardly till the sliding element is locked to the bottom portion of the leg pole to unfold the tent.
Figure 6:
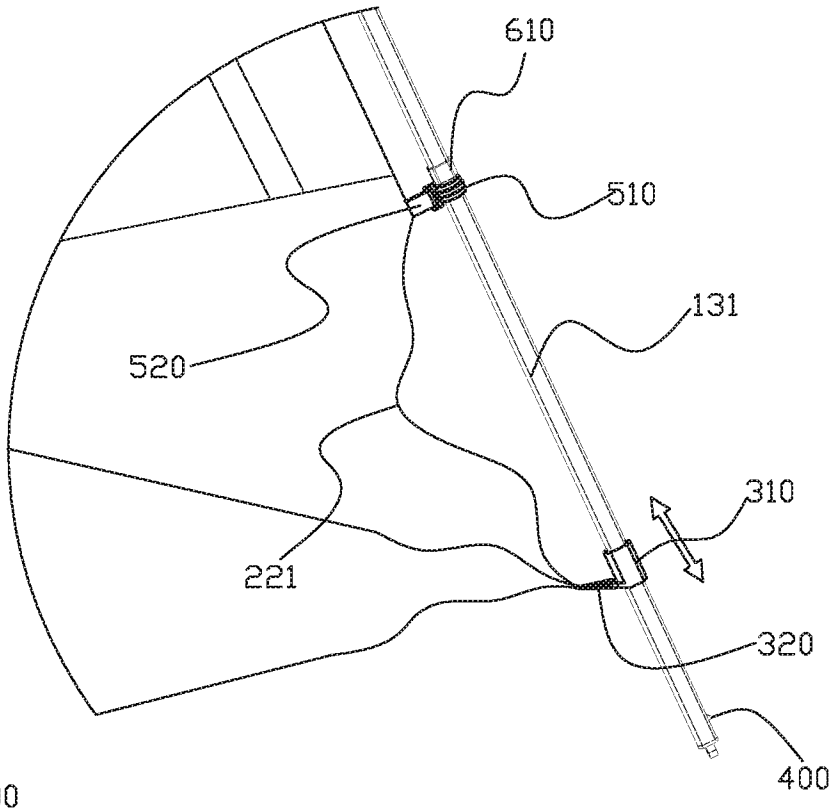
FIG. 6 illustrates a schematic diagram of the connecting structure of the tent cloth and the leg pole when the sliding element slides from top to bottom in a second position.
Figure 5:
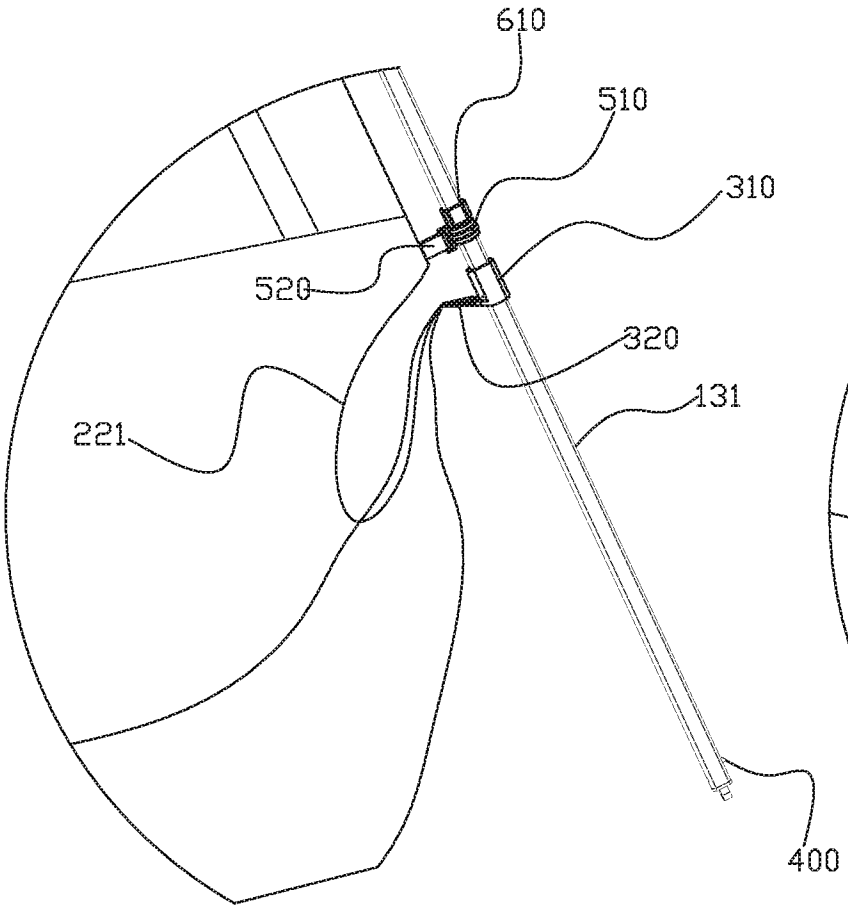
FIG. 5 illustrates a schematic diagram of the connecting structure of the tent cloth and the leg pole when the sliding element slides from top to bottom in a first position.
Figure 8:
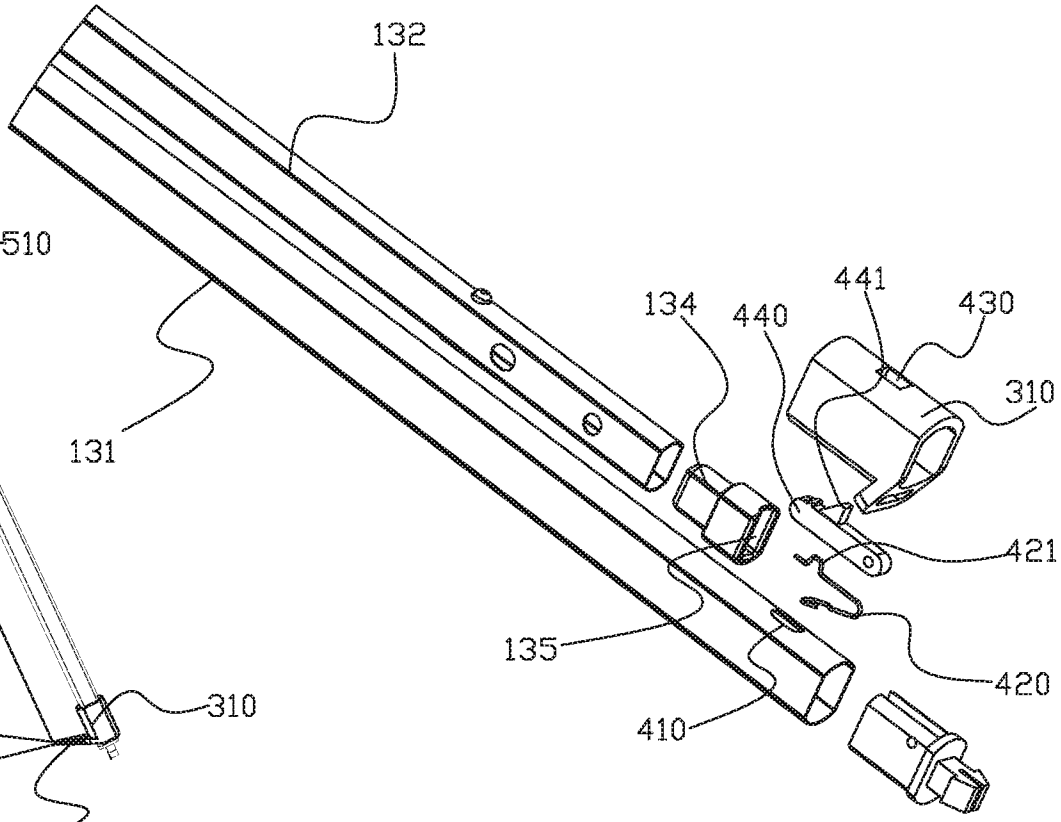
FIG. 8 illustrates an exploded and schematic diagram of partial connecting structure of the tent cloth and the leg pole.
Figure 7:
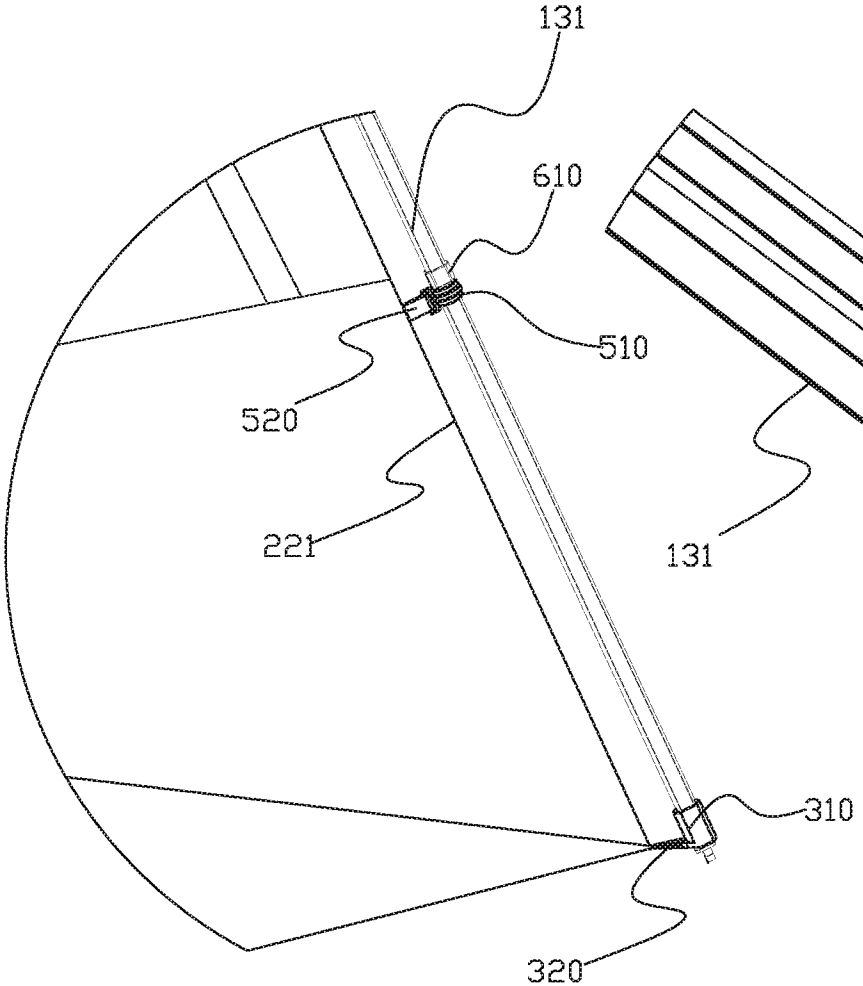
FIG. 7 illustrates a schematic diagram of the connecting structure of the tent cloth and the leg pole when the sliding element slides from top to bottom in a third position and the sliding element is locked to the bottom portion of the leg pole.

Unfolding process: referring to FIG. 4, rotating and unfolding the leg poles and the top tent poles and stretching the leg poles, the leg poles are in stretching state; referring to FIG. 1, FIGS. 5-7, slide the sliding element 310 downwardly until the sliding element 310 is locked to the bottom portion of the first pole 131 by the lock structure, the tent rack is firstly open, the limit structure makes the upper portion of the tent cloth flat, the tent keeps by itself although the bottom is loose, the tent is open and closed easily, the appearance is clean and attractive; sliding the sliding element to flatten the bottom portion of the tent cloth, making the bottom of the cloth flat; the operation is convenient.

In this embodiment, the sliding element is a sliding base, but not limited to this, the sliding element can be extended to form a third pole, one end of the first flexible element is connected to the bottom portion of the tent cloth, the other end is connected to the bottom portion of the third pole, so that the unlock structure is used to lock the third pole and the first pole in stretching state.

Figure 14:
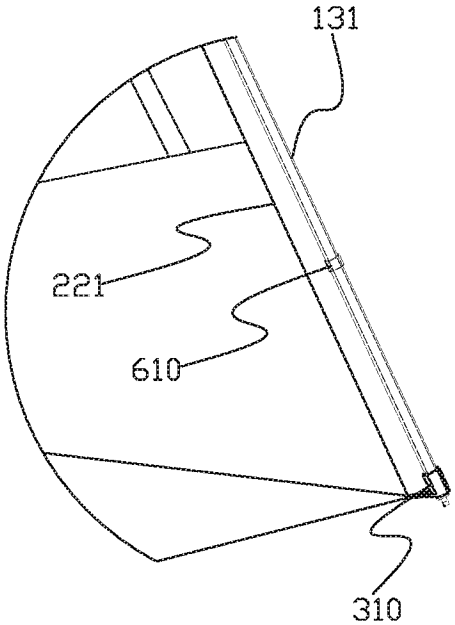
FIG. 14 illustrates a schematic diagram of the connecting structure of the tent cloth and the leg pole in another embodiment when the sliding element slides from top to bottom in a third position.
Figure 13:
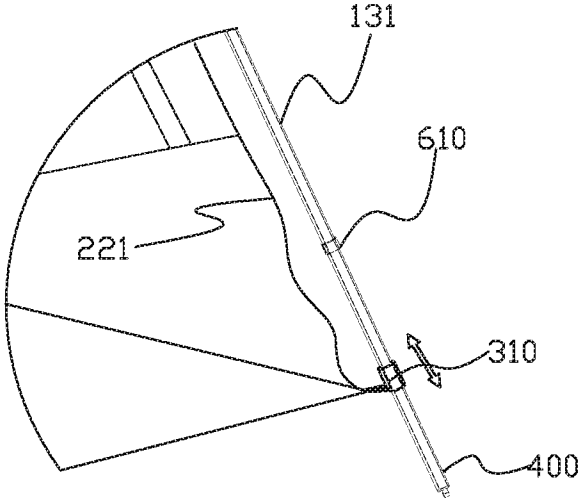
FIG. 13 illustrates a schematic diagram of the connecting structure of the tent cloth and the leg pole in another embodiment when the sliding element slides from top to bottom in a second position.
Figure 12:
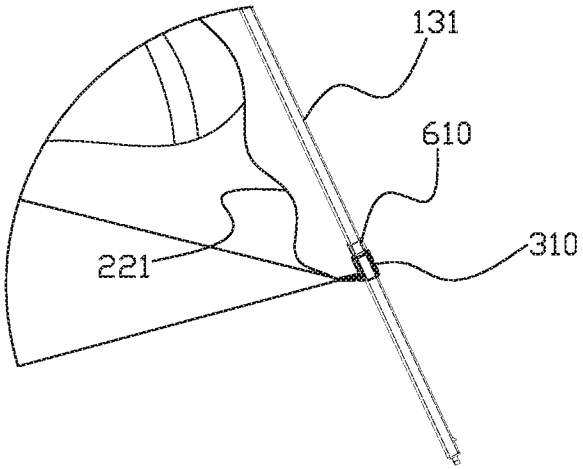
FIG. 12 illustrates a schematic diagram of the connecting structure of the tent cloth and the leg pole in another embodiment when the sliding element slides from top to bottom in a first position.

In another embodiment, it differs from the first embodiment in that: referring to FIGS. 12-14, the second connecting unit is omitted, the limit structure limits the sliding sleeve to pass through the protruding and slide up along the first pole.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A tent cloth connecting structure for a fold-up tent, comprising:

a leg pole that has a length which is adjustable and that is comprised of a first pole and a second pole that are slidable relative to one another to change the length of the leg pole; and a tent cloth that has a lower portion that is disposed with a first connecting unit which tensions the tent cloth and which comprises a first flexible element; a second connecting unit that is disposed above the first connecting unit and that is connected to the first pole and that further tensions the tent cloth; and a sliding element which is attached to the tent cloth and which is slidably connected to the first pole, wherein the sliding element and the lower portion of the first pole are disposed with a locking structure that retains the sliding element in position with the lower portion of the first pole, wherein the first pole is disposed with a limit structure that limits passage of the second connecting unit through the limit structure and sliding up along the first pole, and that comprises a protruding portion that is fixedly connected to the first pole and that protrudes with respect to an external wall of the first pole, and wherein the second connecting unit comprises a connecting base that is slidably connected to the first pole, that is located below the protruding portion which limits the passage of the connecting base through the protruding portion and sliding up along the first pole, and a second flexible element that connects the connecting base and the tent cloth.

2. The tent cloth connecting structure according to claim 1, wherein the sliding element comprises a sliding base slidably connected to the first pole.

3. The tent cloth connecting structure according to claim 1, wherein the first flexible element of the first connecting unit connects the sliding element and the tent cloth.

4. A tent cloth connecting structure for a fold-up tent, comprising:

a leg pole that has a length which is adjustable and that is comprised of a first pole and a second pole that are slidable relative to one another to change the length of the leg pole; and a tent cloth that has a lower portion that is disposed with a first connecting unit that tensions the tent cloth and that comprises a sliding element which is attached to the tent cloth and which is slidably connected to the first pole, and wherein the sliding element and a lower portion of the first pole are disposed with a locking structure that retains the sliding element of the first connecting unit in position with the lower portion of the first pole, wherein, when the second pole slides relative to the first pole to extend from the first pole, the leg pole is in a stretched state and, when the second pole slides relative to the first pole so as to be disposed within the first pole, the leg pole is in a contracted state, wherein, when the leg pole slides to change from the stretched state to the contracted state, the locking structure is unlocked, wherein the first pole is a tube and the second pole is slidably inserted into the first pole, wherein the locking structure comprises:

a through hole defined through the tube of the first pole;

an elastic lock disposed within the tube of the first pole and having ends that provide an elastic biasing force; and a lock hole defined in the sliding element, and wherein one end of the elastic lock is fixedly connected to an inner wall of the tube of the first pole and another end is disposed with a locking portion that is disposed with a column which passes through the through hole under the action of the elastic biasing force between the two ends of the elastic lock so that the locking structure locks the sliding element to the lower portion of the first pole when the leg pole changes from the contracted state to the stretched state.

5. The tent cloth connecting structure according to claim 4, wherein the column has a top surface that is disposed with a second guiding surface, and wherein the second pole has a bottom end portion that is disposed with a guiding base that abuts against the second guiding surface such that, when the second pole slides downwardly, the locking portion moves to retract the column from the through hole.

6. The tent cloth connecting structure according to claim 4, wherein the second pole has a bottom end portion that is fixedly disposed with a guiding base, wherein the guiding base has a bottom surface that is concaved and disposed with a groove having a groove wall that is disposed with a first guiding surface, and wherein the first guiding surface abuts against the locking portion so that, when the second pole slides downwardly, the locking portion moves to retract the column from the through hole.

* * * * *